United States Patent [19]

Nakashima et al.

[11] Patent Number: 4,927,788

[45] Date of Patent: May 22, 1990

[54] MONOLITHIC FEMALE CONNECTOR

[75] Inventors: Kazutaka Nakashima; Kazuya Saito, both of Hachioji, Japan

[73] Assignees: Dowa Mining Co., Ltd.; Yazaki Corporation, both of Tokyo, Japan

[21] Appl. No.: 277,496

[22] Filed: Nov. 29, 1988

Related U.S. Application Data

[63] Continuation-in-part of Ser. No. 177,997, Apr. 5, 1988, abandoned.

[30] Foreign Application Priority Data

Apr. 8, 1987 [JP] Japan ..... 62-84653

[51] Int. Cl.[5] ..... C22C 9/06

[52] U.S. Cl. ..... 439/887; 148/435; 148/436; 420/486

[58] Field of Search ..... 420/486; 148/435, 436; 439/816, 834, 851, 852, 862, 865, 867, 877, 887

[56] References Cited

U.S. PATENT DOCUMENTS

| | | | |
|---|---|---|---|
| 1,509,608 | 9/1924 | Northover | 420/486 |
| 2,034,562 | 3/1936 | Davis et al. | 420/486 |
| 2,514,336 | 7/1950 | Paige | 439/867 |
| 2,851,353 | 9/1958 | Roach et al. | 420/486 |
| 3,363,224 | 1/1968 | Gluntz | 439/852 |
| 3,425,030 | 1/1969 | Hadden | 439/851 |
| 3,697,934 | 10/1972 | Merry | 439/852 |
| 4,338,130 | 7/1982 | Burkett | 420/486 |
| 4,564,259 | 1/1986 | Vandame | 439/852 |
| 4,593,963 | 6/1986 | Endo et al. | 439/852 |

FOREIGN PATENT DOCUMENTS

| | | | |
|---|---|---|---|
| 6735 | 2/1974 | Japan | 420/486 |
| 34154 | 2/1983 | Japan | 420/486 |
| 248228 | 8/1969 | U.S.S.R. | 420/486 |
| 413332 | 7/1934 | United Kingdom | 420/486 |
| 1161610 | 8/1969 | United Kingdom | 420/486 |
| 1194632 | 6/1970 | United Kingdom | 420/486 |
| 1289301 | 9/1972 | United Kingdom | 420/486 |
| 1312725 | 4/1973 | United Kingdom | 420/486 |
| 1582428 | 1/1981 | United Kingdom | 420/486 |

OTHER PUBLICATIONS

Guha et al., "The Development of a New High-Strength Copper-Based Alloy for Marine Service", Journal of the Institute of Metals, vol. 99, 1977, pp. 148-155.

*Primary Examiner*—Robert McDowell

*Attorney, Agent, or Firm*—Frishauf, Holtz, Goodman & Woodward

[57] ABSTRACT

A monolithic female connector made of a copper-base alloy consisting essentially of 7-15 wt % Ni, 1.0-2.0 wt % Al, no more than 0.0050 wt % $O_2$, and the balance of Cu and incidental impurities is highly useful as an electrical connector element of low signal current used in automobiles, because it is made of the alloy having improved bendability while satisfying high electrical conductivity and spring limit.

9 Claims, 3 Drawing Sheets

MONOLITHIC FEMALE CONNECTOR

This is a continuation-in-part of application Ser. No. 177,997 filed Apr. 5, 1988 now abandoned.

BACKGROUND OF THE INVENTION

The present invention relates to a female connector half of an electrical connector (hereinafter referred to as "female connector") that permits the passage of low signal current in such applications as electric wire harnesses in automobiles, characterized in that said female connector is formed in a monolithic structure with a novel copper-base alloy.

A female connector generally consists, as shown in FIG. 2, of a socket portion 1 and a wire-connecting portion 2, said socket portion having therein a spring element 3 and accepting the insertion of a male connector.

While electrical connectors that permit the passage of low signal currents in such applications as electric wire harnesses in automobiles are required to have several properties, female connector halves must particularly meet the following requirements: good spring properties and amenability to working or machining into complex shapes; ease of selective plating with gold intended to reduce the contact resistance of the contact area; and ease of tin plating performed to prevent discoloration of substrate surfaces and to provide good solderability.

However, no single materials available today possess all of these properties simultaneously, and female connectors are conventionally fabricated from combinations of spring materials having good spring properties with frame materials featuring high ratings of machinability. Namely, the spring element 3 shown in FIG. 2, and the frame element (the socket portion 1 and the wire-connecting portion 2 shown in the same figure are prepared in two separate steps and they are assembled later into a single element. Commonly employed spring materials are beryllium copper (C-1720) and Cu-9% Ni-6% Sn alloy, and typical frame materials are made of brass (C-2600) or Cu-0.1% Fe-0.03% P alloy that feature high ratings of machinability.

This prior art technique, however, has had the following problems.

(1) Spring materials are gold plated in the contact area in order to reduce contact resistance, and tin plated in other areas in consideration of corrosion resistance and solderability. However, materials used as spring elements exhibit the intended spring properties only after they are age-hardened in the temperature range of 315°–450° C. following pressing into a desired shape. This requires plating with a desired metal after pressing but this post-pressing plating method leads to an increased production cost as compared with a method in which plating precedes the pressing operation.

(2) Beryllium copper is easily workable when it is in a unhardened state but its high price makes it an uneconomical material for use in the fabrication of a monolithic female connector half.

(3) Making spring and frame members from different alloys and assembling them into a single element are not cost-effective because of the increased number of fabrication steps involved.

(4) With the recent tendency of using electrical connectors in more hostile environments, it has become necessary to ensure that the contact pressure will not change under prolonged exposure to temperatures between about 150° and 200° C. However, the prior art connectors fabricated from the combination of two different materials are unable to meet this requirement.

(5) The scrap of the prior art two-piece female connector cannot be recycled by an economical method since separating the spring material from the frame material requires costly treatments.

SUMMARY OF THE INVENTION

An object, therefore, of the present invention is to provide an economical electrical female connector made of material that possesses the properties described above and which can be worked into a monolithic structure of spring and frame portions. Representative values of the characteristics required for this material are shown below for illustrative purposes:

(i) Electrical conductivity: 10–20% IACS;

(ii) Spring limit: $\geqq 45$ Kgf/mm$^2$;

(iii) Workability with press: Good bent surface is obtained in 90° W bending test (CES-M-0002-6) at $R/t=1.0$ where R is the bending radius and t is the thickness of a plate under test;

(iv) Stress relaxation characteristics which serve as an index for stability in the contact pressure of spring: because, this overlapping was made by mistake:

No more than 10% stress relaxation after exposure to 200° C.$\times$500 h;

(v) Reliability of plating: No Au or Sn plated coat separation occurs in 90° W bend test after exposure to 150° C.$\times$500 h.

The above-stated object of the present invention can be attained by a monolithic female connector made of a copper-base alloy that consists essentially of 7–15 wt % Ni, 1.0–2.0 wt % Al, no more than 0.0050 wt % $O_2$, and the balance being Cu and incidental impurities.

DETAILED DESCRIPTION OF THE INVENTION

In the copper base alloy to be used in the present invention, Ni is an essential element that is beneficial to the purpose of improving the strength and corrosion resistance of the alloy. In particular, Ni forms a fine-grained intermetallic compound of $Ni_xAl_y$ together with the concomitantly added Al and this compound is precipitated in the copper matrix to provide increased values of strength and spring limit. If the Ni content exceeds 15 wt %, the electrical conductivity of the alloy is reduced. At the same time, the high Hi content increases the price of the alloy as a connector material. Even if the Ni content is less than 7 wt %, the strength and spring limit of the alloy can be improved by increasing the Al content but then the bendability of the alloy is impaired. Therefore, the content of Ni in the copper-base alloy to be used in the present invention is limited to be within the range of 7–15 wt %.

Aluminum is also an essential element in the copper base alloy to be used in the present invention in that it contributes to an improvement in the strength and spring limit of the alloy. If the Al content exceeds 2.0 wt %, the bendability of the alloy is impaired and it becomes impossible to fabricate a monolithic female connector. If the Al content is less than 1.0 wt %, satisfactory improvements in the strength and spring limit of the alloy are not attainable. Therefore, the content of Al in the copper-base alloy of the present invention is limited to be within the range of 1.0–2.0 wt %.

If oxygen ($O_2$) is present in an amount exceeding 50 ppm, it will react with Al in the alloy to form $Al_2O_3$ and the amount of Al available for contribution to increased strength is reduced. Furthermore, $Al_2O_3$ is dispersed in the matrix and becomes problematic in that the service life of molds used in pressing the alloy is shortened. Therefore, the oxygen content in the alloy to be used in the present invention must be limited to less than 50 ppm.

The monolithic female connector of the present invention will be explained in more detail below referring to the attached drawings.

Figure 3:
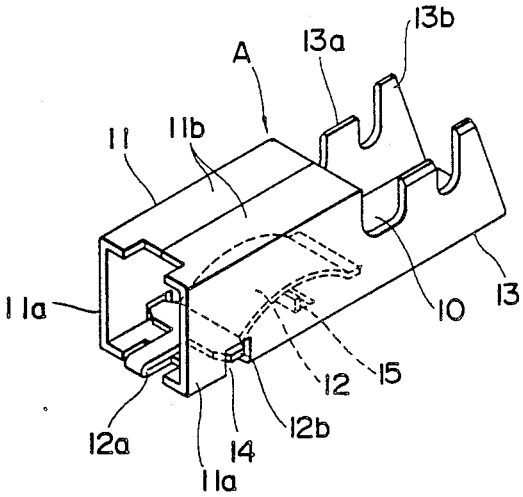
FIG. 3 is a perspective view of a female connector of the present invention.
Figure 4:
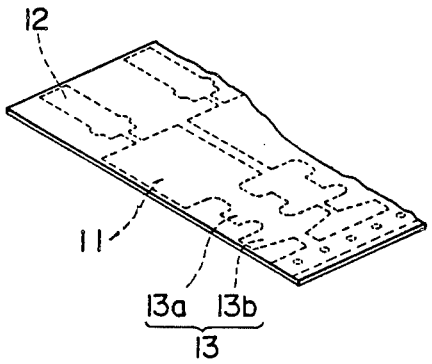
FIG. 4 is a view to illustrate how to shape the body of the female connector of the present invention from a thin metal plate.
Figure 5:
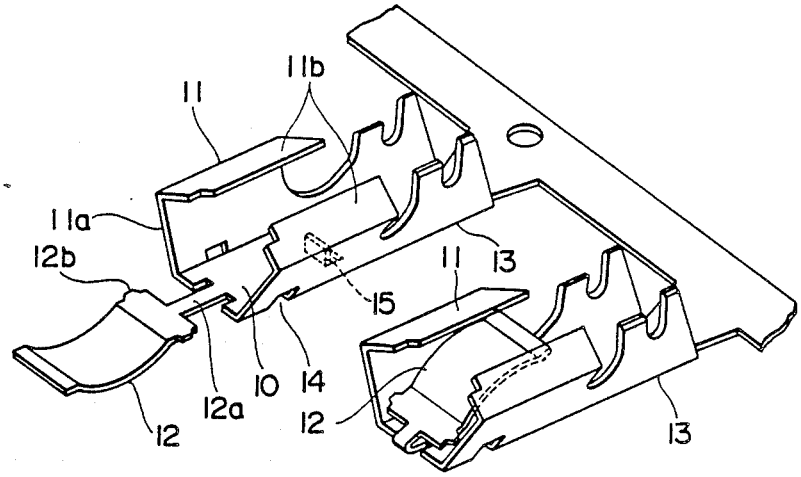
FIG. 5 is a perspective view to illustrate the female connector of the present invention which is in mid course of production.

As shown in FIGS. 3 through 5, the female connector "A" has a monolithic structure consisting of a base plate 10 having on one side thereof, a socket portion 11 to which a male connector mates with the aid of a spring element 12 contained in the socket portion, and having on another side thereof a wire-connecting portion 13 (see FIG. 3). The female connector "A" is one having a monolithic structure that has been made by a simple process comprising steps of press-working and punching from a thin plate of a novel copper-base alloy consisting essentially of 7–15 wt % Ni, 1.0–2.0 wt % Al, no more than 0.0050 wt % $0_z$ and the balance of Cu and incidental impurities.

It differs from a conventional prior art female connector in that it has a monolithic structure consisting of a socket portion, a spring element and a wire-connecting portion, all being made of one and the same thin plate of a novel copper-base alloy.

The following examples are provided for the purpose of further illustrating the present invention but are in no way to be taken as limiting.

EXAMPLE 1

Alloys having the analytical values of compositions shown in Table 1 were melted in a high-frequency vacuum melting furance to cast ingots measuring 40 mm wide, 40 mm thick and 150 mm long. After sculping their surface, the ingots were homogenized at 900° C., hot rolled and immediately quenched. The hot rolled plates were then subjected to repeated cycles of cold rolling and solid solution treatment at 900° C. until a plate thickness of 0.8 mm was attained. The cold rolled paltes 0.8 mm thick were quenched with water immediately after a solid solution treatment at 900° C. for 20 minutes. Thereafter, the plates were subjected to the final stage of cold rolling to attain 50% reduction to a thickness of 0.4 mm, followed by age hardening at 500° C. for 30 minutes.

Test pieces were taken from each of the plate samples thus prepared and subjected to measurements of mechanical strength, elongation, hardness, spring limit, electrical conductivity and bendability. The results are shown in Table 1 together with the compositions of the starting alloys.

Mechanical strength and elongation were measured in accordance with JIS Z 2241, electrical conductivity to JIS H 0505, hardness to JIS Z 2244, and spring limit to JIS H 3130. Bendability was evaluated by a 90° W bend test in accordance with CES M 0002-6 at R/t of 1.0 (R = bending radius set at 0.4 mm; t = plate thickness which is 0.4 mm). The results noted under G.W. in Table 1 were obtained when the bending axis was perpendicular to the rolling direction, and those given under B.W. were obtained when the bending axis was parallel to the rolling direction. The bendability of the test pieces was evaluated by the following criteria: O, the surface of the bend was satisfactory; Δ, creases developed in the surface of the bend; X, the surface of the bend either cracked or ruptured.

As the data in Table 1 shows, alloy samples Nos. 1–5 within the scope of the present invention satisfied all of the characteristics including spring limit, electrical conductivity and bendability that are intended to be attained by the present invention and which are set forth herein. However, samples Nos. 6 and 7 (comparison) that contained more Al than specified by the present invention had poor bendability whether the Ni content was high (as in sample No. 6) or low (sample No. 7). Sample No. 8 (comparison) containing less Al than specified by the present invention was low not only in strength and spring limit but also in hardness. In addition, its electrical conductivity and bendability were not satisfactory. Sample No. 9 (comparison) containing more $O_2$ than specified by the present invention was poor in bendability although its Al content (and Ni content, too) was within the range specified by the present invention.

As is obvious from the above explanation, samples Nos. 1–7 are the alloys suitable for producing the monolithic female connectors of the present invention and samples Nos. 6–9 are not suitable for the same purpose because of their defects in some aspects.

TABLE 1

| Sample No. | | Compositional analysis (wt %) Ni | Al | $O_2$ | Cu | Strength (kgf/mm²) | Spring limit (kgf/mm²) | Elongation (%) | Electrical conductivity (% IACS) | Hardness (Hv) | Bendability G.W. | B.W. |
|---|---|---|---|---|---|---|---|---|---|---|---|---|
| Sample of the invention | 1 | 15.0 | 1.5 | 0.0029 | bal. | 81 | 58 | 17 | 10 | 243 | O | O |
| | 2 | 11.0 | 1.6 | 0.0032 | bal. | 79 | 60 | 20 | 13 | 251 | O | O |
| | 3 | 10.9 | 1.0 | 0.0024 | bal. | 67 | 46 | 18 | 13 | 210 | O | O |
| | 4 | 8.7 | 1.7 | 0.0030 | bal. | 73 | 52 | 19 | 15 | 236 | O | O |
| | 5 | 7.0 | 1.0 | 0.0042 | bal. | 61 | 45 | 21 | 18 | 189 | O | O |
| Comparative samples | 6 | 15.0 | 2.3 | 0.0035 | bal. | 93 | 81 | 12 | 10 | 303 | X | X |
| | 7 | 6.8 | 2.3 | 0.0040 | bal. | 74 | 69 | 3 | 13 | 260 | X | X |
| | 8 | 15.0 | 0.2 | 0.0036 | bal. | 45 | 40 | 8 | 8 | 144 | Δ | Δ |

TABLE 1-continued

| Sample No. | Compositional analysis (wt %) Ni | Al | $O_2$ | Cu | Strength (kgf/mm²) | Spring limit (kgf/mm²) | Elongation (%) | Electrical conductivity (% IACS) | Hardness (Hv) | Bendability G.W. | B.W. |
|---|---|---|---|---|---|---|---|---|---|---|---|
| 9 | 11.0 | 1.7 | 0.0102 | bal. | 87 | 82 | 10 | 13 | 286 | X | X |

Reduction in the final stage of plate rolling: 50%; plate thickness: 0.4 mm; final heat treatment: 500° C. × 30 min.

EXAMPLE 2

A copper-base alloy consisting essentially of 11 wt % Ni, 1.7 wt % Al and no more than 0.0050 wt % $O_2$ with the balance being Cu and incidental impurities was melted in a high-frequency melting furnace and an ingot (10 $mm^T \times 50$ $mm^W \times L$ $mm^L$) was made by horizontal continuous casting. Plates 0.4 mm thick were prepared from the ingot as in Example 1, and subsequently age-hardened by treatment at 500° C. for 30 minutes. Various characteristics of the plates were investigated as in Example 1 and the results are shown in Table 2.

As comprisons, a commercial grade of phosphor bronze as a spring material (C-5210 EH) and beryllium copper (C-1720 ¼H) that had been heat treated at 315° C. for 2.5 hours were subjected to investigations of their characteristics. The results are also shown in Table 2.

The data in Table 2 shows that the alloy prepared in accordance with the present invention had better bendability than phosphor bronze and beryllium copper.

The three types of alloys were also tested for their stress relaxation characteristics by the following procedure: a test piece was bent by applying a load that would exert a maximum bending stress of 60 Kgf/mm² and after holding it at 200° C. for a predetermined period (up to 500 h), the load was removed and the amount (%) of deformation occurring in the test piece was measured. The results are depicted in FIG. 1.

Figure 1:
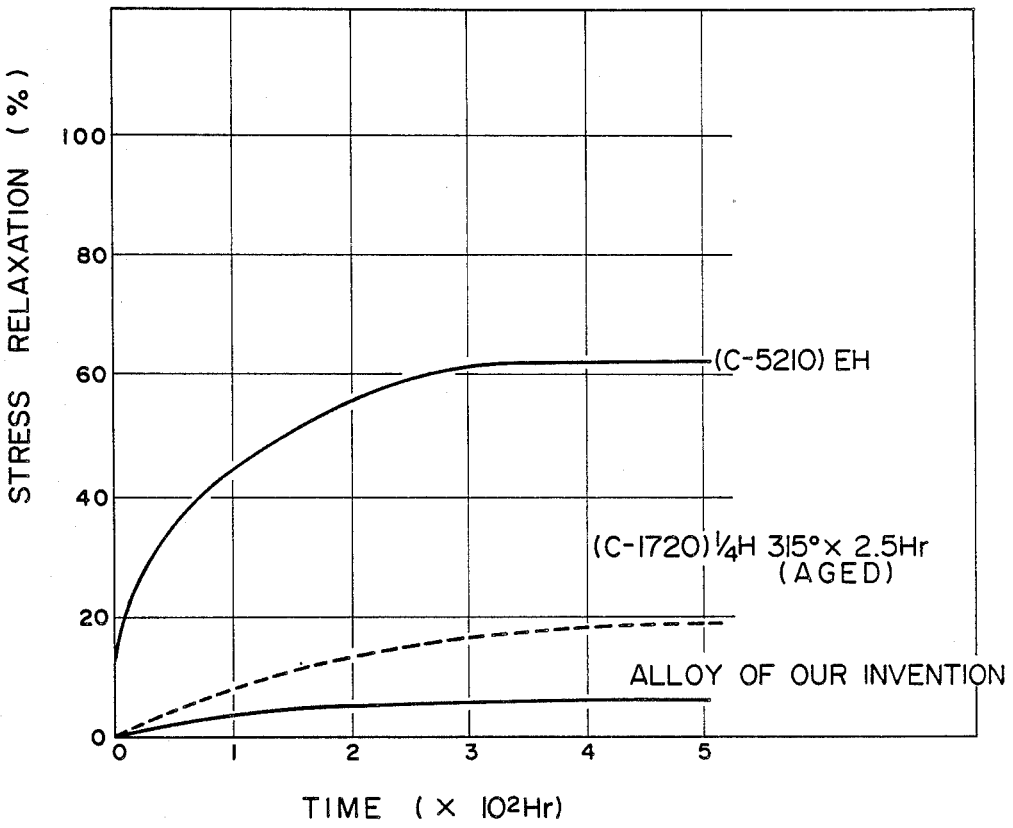
FIG. 1 is a graph showing the stress relaxation of three different Cu base alloys as a function of the time for which they were exposed to 200° C.
Figure 2:
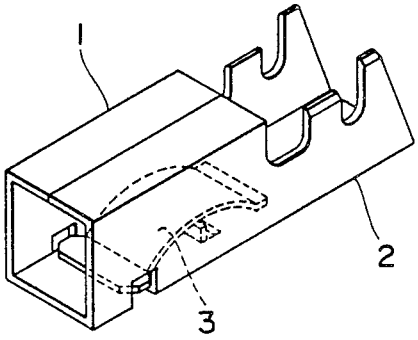
FIG. 2 PRIOR ART
FIG. 2 is a perspective view of a prior art female connector.

As FIG. 1 shows, the phosphor bronze C-5210 EH was the poorest in stress relaxation characteristics and even the beryllium copper C-1720 ¼H showed more than 10% stress relaxation when exposed to 200° C.for 100 hours and longer. The alloy of the present invention showed only about 5% stress relaxation even when exposed to 200° C.for 500 hours and longer, indicating that it would display stable contact pressure when used as a spring material under these conditions.

The three alloys were also subjected to a test for checking the reliability for plating for the following procedures. First, the three alloys were plated with either gold or tin. Gold plating consisted of electrolytic degreasing, acid dipping, strike-plating with copper plating with nickel in a Watts bath, alkali degreasing, acid dipping, and plating with a 0.2 μm gold deposit in an acidic bath. Tin plating consisted of electrolytic degreasing, acid dipping, plating with a Cu undercoat (for only half of the samples), and plating with a 2 μm thick mat tin deposit in a sulfate bath. All alloys under test exhibited good platability whether the metal to be deposited was gold or tin.

The plated alloy samples were then heat treated at 150° C.for 500 hours and subjected to a 90° W bend test. The results of investigation of adhesion of plated coating to the substrate in bent portions are shown in Table 3.

As is clear from Table 3, both Au and Sn plates adhered strongly to the alloy of the present invention except when an Sn plate was deposited on the Cu undercoat. The poor adhesion of the Sn plate deposited on the Cu undercoat could be traced to the nature of the plate coating per se because separation would have started from an intermetallic compound of Cu and Sn formed at the interface between the Cu undercoat and the Sn coating. In contrast, the Sn plate separated from each of the phosphor bronze C-5210 EH and beryllium copper C-1720 ¼H irrespective of whether it was deposited on the Cu undercoat or not. It was therefore established that the alloy of the present invention has very good platability.

TABLE 2

| Sample | Strength (kgf/mm²) | Spring limit (kgf/mm²) | Elongation (%) | Electrical conductivity (% IACS) | Hardness (Hv) | Bendability G.W. | B.W. |
|---|---|---|---|---|---|---|---|
| Alloy of the invention* | | | | | | | |
| Cu-11 wt % Ni-1.7 wt % Al | 83 | 67 | 17 | 14 | 257 | O | O |
| C-5210 EH | 74 | 60 | 18 | 12 | 245 | O | X |
| C-1720 ¼H** | 123 | 112 | 7 | 22 | 385 | X | X |

*Heat treated at 500° C. × 30 min.
**Heat treated at 315° C. × 2.5 h

TABLE 3

| Sample | Plating Reliability Test (150° C. × 500 h) Au plated coat | Sn plated coat (with no Cu undercoat) | Sn plated coat (with Cu undercoat) |
|---|---|---|---|
| Alloy of the invention | good | good | separated |
| C-5210 EH | good | separated | separated |
| C-1720 ¼H | good | separated | separated |

EXAMPLE 3

A female connector "A" consisting of a spring element 12, a soket portion 11 and a wire-connecting portion 13 was prepared by a single process comprising the steps of press working and punching. along the dotted lines shown in FIG. 4. a thin plate of a copper-base alloy consisting of 10 wt % Ni. 1.5 wt % Al 0.0040 wt % $0_z$ and the balance of the Cu and incidental impurities.

The socket portion 11 is formed of a base plate 10, two side walls 11*a* standing at both ends of said base plate 10, and the ceiling 11*b* formed by bending free end portions of said side walls 11*a* at approximately right angles from the walls in such a way that the edges of the bent portions of the walls meet each othr over the base plate 10.

The wire-connecting portion 13 has pairs of holder walls 13*a* and 13*b* which serve, respectively, as a holder of coductor of the wire and a holder of insulator of the wire.

The spring element 12 of the female connector is formed by folding back, into the inside of the socket portion 11. the strip portion 12 (see FIG. 5) which is given as a continuosly extended portion of the base plate 10 having a narrow connect band portion 12*a* between said strip 12 and the base plate 10. said connect-band portion 12*a* being given at the entrance of the female connector through which a male connector is inserted into the female connector.

The spring element 12 has small projections 12*b* near the lower end of the spring element and at both sides thereof.

These projections 12*b* are to be fitted in the holes 14 given in the two side walls 11*a* to prevent the instability of the spring element 12 when a male connector is mated to the female connector.

A click 15 which serves to prevent the yield of the spring element 12 to be caused by the excessively repeated insertion and taking out of the male connector is given in the base plate 10 by cutting part of the base plate itself and bending it upward.

As will be understood from the foregoing examples, the alloy to be used in the present invention has improved bendability while satisfying two other requirements, i.e., high electrical conductivity and spring limit, called for connector materials, especially those for conducting low signal currents in electric wire harnesses in automobiles. Therefore, according to the present invention, a connector material improved over a prior art version (two-piece element) is offered in that it can be fabricated into a monolithic structure in which spring and frame portions make a unitary assembly. The alloy to be used in the present invention does not contain any precious element such as the one incorporated in beryllium copper alloy and yet realizes better stress relaxation characteristics. Besides these advantages in terms of economy and characteristics, plates deposited on this alloy to make an electrical connector have sufficient reliability to permit its service up to a temperature of 200° C. Therefore, the present invention offers an inexpensive and novel item to the area of connector materials.

What is claimed is:

1. A female connector of a monolithic structure comprising a spring element, a socket portion and a wire-connecting portion, said spring element, socket portion and wire-connecting portion being integrally formed as one piece by press-working and punching from a single thin plate made of a copper-base alloy consisting essentially of 7–15 wt % Ni, 1.0–2.0 wt % Al, not more than 0.0050 wt % $0_2$ and the balance of Cu and incidental impurities, said thin plate having a uniform thickness.

2. The female connector of claim 1 wherein said copper-base alloy consists essentially of 15.0 wt % Ni, 1.5 wt % Al, 0.0029 wt % $0_z$, and the balance of Cu and incidental impurities.

3. The female connector of claim 1 wherein said copper-base alloy consists essentially of 11.0 wt % Ni. 1.6 wt % Al. 0.0032 wt % $0_2$ and the balance of Cu and incidental impurities.

4. The female connector of claim 1 wherein said copper-base alloy consists essentially of 10.9 wt % Ni,, 1.0 wt % Al. 0.0024 wt % $0_2$ and the balance of Cu and incidental impurities.

5. The female connector of claim 1 wherein said copper-base alloy consists essentially of 8.7 wt % Ni, 1.7 wt % Al, 0.0030 wt % $0_z$ and the balance of Cu and incidental impurities.

6. The female connector of claim 1 wherein said copper-base alloy consists essentially of 7.0 wt % Ni, 1.0 wt % Al, 0.0042 wt % $0_2$ and the balance of Cu and incidental impurities.

7. The female connector of claim 1 wherein said copper-base alloy consists essentially of 11 wt % Ni. 1.7 wt % Al, less than 0.0050 wt % $0_z$ and the balance of Cu and incidental impurities.

8. The female connector of claim 1 wherein said copper-base alloy consists essentially of 10 wt % Ni, 1.5 wt % Al, 0.0040 wt % $0_z$ and the balance of Cu and incidental impurities.

9. The female connector of claim 1 wherein said plate has the following properties:

(i) electrical conductivity: 10–20% IACS;

(ii) spring limit: $\geqq 45$ Kgf/mm$^2$;

(iii) workability with press: good bent surface is obtained in 90° W bending test (CES-M-0002-6) at R/t=1.0 where R is the bending radius and t is the thickness of a plate under test;

(iv) stress relaxation characteristics which serve as an index for stability in the contact pressure of spring; No more than 10% stress relaxation after exposure to 200° C.×500 h; and (v) reliability of plating: no Au or Sn plated coat separation occurs in 90° W bend test after exposure to 150° C.×500 h.

* * * * *